United States Patent [19]

Warren et al.

[11] Patent Number: 4,887,677

[45] Date of Patent: Dec. 19, 1989

[54] LOW PRESSURE DRILL BIT

[75] Inventors: Tommy M. Warren, Coweta; Suzanne M. Behr, Tulsa, both of Okla.

[73] Assignee: Amoco Corporation, Chicago, Ill.

[21] Appl. No.: 274,592

[22] Filed: Nov. 22, 1988

[51] Int. Cl.[4] ..... E21B 10/60

[52] U.S. Cl. ..... 175/339; 175/393

[58] Field of Search ..... 175/65, 339, 340, 393, 175/424, 324

[56] References Cited

U.S. PATENT DOCUMENTS

| | | | |
|---|---|---|---|
| 2,946,565 | 7/1960 | Williams | 175/65 |
| 3,455,402 | 7/1969 | Tiraspolsky | 175/393 |
| 3,825,080 | 7/1974 | Short | 175/65 |
| 4,223,747 | 9/1980 | Marais | 175/65 |
| 4,239,087 | 12/1980 | Castel et al. | 175/340 |
| 4,240,513 | 12/1980 | Castel et al. | 175/340 |
| 4,452,324 | 6/1984 | Jurgens | 175/393 |
| 4,515,227 | 5/1985 | Cerkovnik | 175/65 |
| 4,633,958 | 1/1987 | Mouton | 175/65 |
| 4,696,354 | 9/1987 | King et al. | 175/393 |
| 4,727,946 | 3/1988 | Barr et al. | 175/393 |

*Primary Examiner*—Bruce M. Kisliuk

*Attorney, Agent, or Firm*—Scott H. Brown; Fred E. Hook

[57] ABSTRACT

A drill bit includes a drill bit body, a cutting member and a fluid course extending in front of the cutting member. The fluid course includes a progressively widening diffuser having a particular design which allows pressure recovery in a fluid flowed through an axial bore of the drill bit body, through a narrow throat of the fluid course in front of the cutting member, and out the progressively widening diffuser of the fluid course. As a result, a significantly reduced pressure is obtained in front of the cutting member, which reduced pressure is below a borehole pressure where the drill bit is used.

9 Claims, 20 Drawing Sheets

LOW PRESSURE DRILL BIT

BACKGROUND OF THE INVENTION

1. Field of the Invention

This invention relates to drill bits having an annular pressure exterior of the drill bit when the drill bit is rotated in the borehole. The present invention relates more particularly to a drill bit for providing in a flowing fluid a negative pressure differential between a cutting area of the drill bit and a pressure reference location, such as within the annulus of the borehole exterior to the drill bit.

2. Setting of the Invention

During a drilling process, a drill bit has a drilling efficiency, measured as the rate of penetration through the rock. The drilling efficiency decreases significantly as the differential pressure between the borehole pressure and the pore pressure of the rock being drilled increases. One of the reasons for this phenomenon is caused by the high borehole pressure and subsequent high bit face pressure resisting rapid movement of the cut material in front of the cutting members of the drill bit. This phenomenon can be at least partially offset or improved by decreasing the pressure immediately in front of a cutting member of the drill bit. This can be done by locally accelerating the drilling fluid through a channel passing in front of the cutting member.

It is believed that such acceleration would occur in prior drill bits which conduct drilling fluid through slots which extend adjacent drill bit cutting members and which have cross-sectional areas smaller than the axial bores defined through the bits and connected to the slots. See U.S. Pat. No. 3,938,599 to Horn and U.S. Pat. No. 4,727,946 to Barr, et al. With the acceleration of the fluid, there would occur a drop in pressure in accordance with Bernoulli's principle. Although this pressure drop can favorably affect drilling efficiency, it has heretofore been limited to a nonnegative pressure differential relative to a reference pressure, such as the borehole pressure in the annulus (i.e., the annular pressure). As illustrated in FIG. 1 hereof and further explained hereinbelow, the pressure in a narrow slot in front of a cutting member would be greater than the annular reference pressure. From FIG. 1, the pressure would be within the range between the annular pressure ($P_{annulus}$) and the bit pressure at the top of the bit ($P_{bit}$). The pressure differential, taking $P_{annulus}$ as the reference, would be within the range between zero ($P_{annulus}-P_{annulus}$) and $P_{bit}-P_{annulus}$.

A significant result of enhancing drilling efficiency is the potential for reducing drilling costs; therefore, it is desirable to seek new ways to improve drilling efficiency. One way would be to overcome the aforementioned limit of the pressure drop adjacent a cutting member relative to a reference pressure in the annulus. Thus, there is the need for a drill bit constructed so that the pressure adjacent a cutting member can be dropped even below annular pressure whereby the pressure differential ($\Delta P$) between the cutting member and the annulus would not be limited to the range of $0 \leqq \Delta P \leqq (P_{bit}-P_{annulus})$. That is, there is the need for a drill bit constructed so that a negative pressure differential between a cutting member and the annulus can be obtained whereby the absolute pressure at the cutting member is less than the annular pressure.

SUMMARY OF THE INVENTION

The present invention is contemplated to overcome the foregoing deficiencies and meet the above-described needs. Through its unique construction, the present invention provides a drill bit wherein a negative pressure differential between a cutting member of the drill bit and a reference location can be obtained relative to previously known drill bits. This is done in the present invention by an outlet structure conveying the fluid, after it has passed at least a portion of a cutting member of the drill bit, so that the fluid recovers pressure through controlled discharge of the fluid rather than dissipates energy through abrupt discharge of the fluid.

Consistent with the foregoing, the present invention can be defined as a drill bit comprising: a drill bit body including a fluid flow passage; engagement means, connected to the drill bit body, for engaging material to be drilled by the drill bit in response to rotation of the drill bit; and means, responsive to a fluid flowing through the fluid flow passage at a first velocity, for conducting fluid from the fluid flow passage by the engagement means at a second velocity greater than the first velocity and thereafter at a third velocity less than the second velocity so that the energy differential between the fluid flowing at the second velocity and the fluid flowing at the third velocity is converted to pressure.

DETAILED DESCRIPTION OF PREFERRED EMBODIMENTS

The present invention provides a drill bit comprising a drill bit body which includes a fluid flow passage. The drill bit also comprises engagement means, connected to the drill bit body, for engaging material to be drilled by the drill bit in response to rotation of the drill bit. An example of an engagement means is a flat cutting member having a straight cutting edge. The drill bit further comprises means, responsive to a fluid flowing through the fluid flow passage in the drill bit body at a first velocity, for conducting fluid from the fluid flow passage by the engagement means at a second velocity greater than the first velocity and thereafter at a third velocity less than the second velocity so that the energy differential between the fluid flowing at the second velocity and the fluid flowing at the third velocity is converted to pressure.

When the drill bit is used in creating a borehole having an annular pressure outside the drill bit, this invention produces adjacent the engagement means, in a fluid flowing through the means for conducting, a pressure less than the annular pressure. Thus, the present invention satisfies the need arising from previously known drill bits having fluid courses in which pressure of a flowing fluid is limited to a pressure between bit pressure ($P_{bit}$) present typically at the center of the bit, and the annular pressure ($P_{annulus}$).

Figure 1:
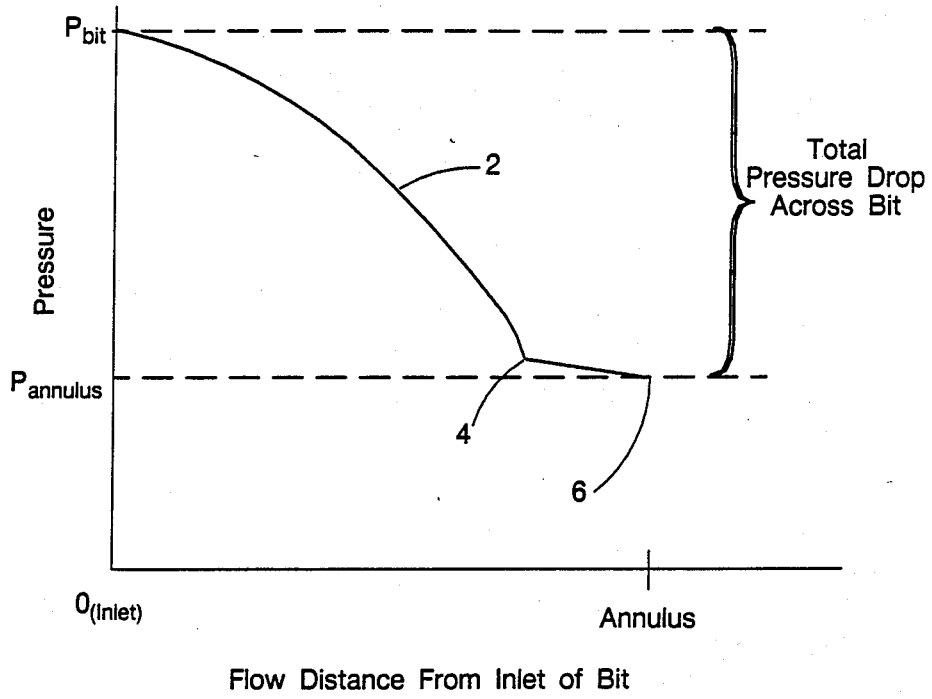
FIG. 1 PRIOR ART
FIG. 1 a graphical representation of pressure distribution through a prior art drill bit which includes a narrowed fluid passage adjacent a cutting member.

This pressure limitation is represented by a graph line or curve 2 in FIG. 1. The curve 2 represents that pressure in such prior drill bits decreases from the center of the drill bit to an outlet of the drill bit opening into the annulus. The curve 2 indicates a design which produces a relatively small positive pressure differential between a point 4 and a point 6. The point 4 represents a location adjacent a cutting member on such a previously known drill bit, and the point 6 represents the location where the fluid course in the previously known drill bit opens into the annulus.

By the present invention, the pressure at a location comparable to that indicated by the point 4 is below $P_{annulus}$. This produces a negative pressure differential relative to annular pressure. Such a significantly lower pressure enhances drilling efficiency.

Referring next to the remaining drawings, the present invention will be more fully described. With reference to FIGS. 2–5, the conceptual and experimental bases for the present invention will be described. Embodiments designed in accordance with these bases will then be described with reference to FIGS. 6–9, 10–11, 12–13, 14–23 and 24–27.

To illustrate how the pressure differential between the borehole (or cutting member) pressure of a drill bit and the pore pressure in the rock affects drilling efficiency, a test was conducted from which five data points were obtained. This type of test is reported in Eric Edward Andersen, "An Experimental Study of the Effects of Differential Pressure on PDC Bit Performance", Graduate Thesis for Tulsa University, Tulsa, Oklahoma, 1988. These are plotted as points 8, 10, 12, 14 and 16 shown in FIG. 2. This test was conducted using a conventional 6¾ in. polycrystalline diamond compact (PDC) drill bit rotated at 100 revolutions per minute in Catoosa shale. A conventional drilling fluid was pumped at a rate of 180 gallons per minute.

Fitting the test data points 8–16 is a curve 18 which shows the inverse relationship between drilling efficiency, expressed as the ratio of the measured rate of penetration to the measured rate of penetration at 250 pounds per square inch (psi), and a differential pressure which was measured between the rock pore pressure which was 0 psi and the pressure in the annulus. The curve shows that as the differential pressure increases, the rate of penetration dramatically decreases. The borehole pressure cannot be decreased much, since its pressure is needed to maintain the walls of the borehole, but the pressure at the cutting members can be reduced. Extrapolating back to a near zero pressure differential from the end point of the curve 18 at 250 psi yielded a dashed line 20. The line 20 represents the extent to which the aforementioned prior drill bits are able to reduce the pressure differential, but this is only possible if the borehole pressure itself is also reduced to that of the pore pressure or close to the pore pressure.

However, our invention can obtain lower and even negative local pressure differentials underneath the bit without reducing the borehole pressure. Thus, our invention can even go beyond the first extrapolation to the left. This region indicates even better efficiencies would be obtained with negative pressure differentials between a cutting member and the annulus/pore pressure. This extended extrapolation is indicated by the dotted line 22. This is the region into which the present invention now extends drill bit technology. Such extension is achieved with a novel and improved drill bit which comprises a drill bit body 24 (including an axial bore 26), a cutting member 28 and a fluid course 30 extending from the axial bore 26 along the drill bit body 24 and including a throat 32 and a particular type of diffuser 34 (see FIG. 6 where these elements, which will be more fully described hereinbelow, are identified).

In developing and evaluating our invention, we used a basic fluid mechanics computer program to show an example of a fluid course which would produce a pressure in front of a cutting member approximately 1000 psi below the annular pressure. The results of this computation are set forth in Table I, and inputs entered in the program to obtain these results are listed in Table II.

TABLE I

| LENGTH | VELOCITY | PRESSURE | VELOCITY HEAD | FRICTION | MINOR | REYNOLDS | FRICTION FACTOR |
|---|---|---|---|---|---|---|---|
| 0.000 | 25.67 | 572.8 | 14.363 | 0.26 | 2.99 | 35731. | 0.006806 |
| 0.250 | 51.34 | 555.2 | 60.610 | 2.56 | 6.40 | 51044. | 0.007029 |
| 0.650 | 104.77 | 485.6 | 68.005 | 4.26 | 0.64 | 59552. | 0.007200 |
| 0.950 | 142.60 | 412.7 | 330.994 | 13.19 | 23.09 | 79402. | 0.007654 |
| 1.150 | 256.69 | 45.4 | 851.129 | 125.69 | 11.90 | 102088. | 0.008164 |
| 1.650 | 427.81 | −944.3 | −84.416 | 115.88 | 0.01 | 100651. | 0.008123 |
| 2.150 | 414.01 | −975.8 | −76.626 | 106.33 | 0.00 | 99253. | 0.008085 |
| 2.650 | 401.07 | −1005.5 | −690.087 | 32.98 | 21.48 | 79402. | 0.007654 |
| 3.150 | 256.69 | −369.9 | −265.977 | 11.44 | 7.81 | 64965. | 0.007329 |
| 3.650 | 171.13 | −123.1 | −136.181 | 3.28 | 9.77 | 47641. | 0.007138 |
| 4.150 | 102.68 | 0.0 | | | | | |

TABLE II

| | |
|---|---|
| FLOW RATE | 40.0 gallons/minute |
| DENSITY | 9.0 pounds/gallon |
| VISCOSITY | 6.0 centipoises |

| LENGTH INCREMENT | WIDTH | DEPTH | ROUGHNESS |
|---|---|---|---|
| .25 | .5 | .5 | 0.001 |
| .4 | .35 | .35 | 0.001 |
| .3 | .30 | .30 | 0.001 |
| .2 | .25 | .20 | 0.001 |
| .5 | .2 | .15 | 0.001 |
| .5 | .2 | .155 | 0.001 |
| .5 | .2 | .16 | 0.001 |
| .5 | .2 | .25 | 0.001 |
| .5 | .25 | .30 | 0.001 |
| .5 | .25 | .5 | 0.001 |
| .5 | .25 | .7 | 0.001 |
| .5 | .25 | .9 | 0.001 |

In Table I, the "pressure" column is the computed pressure value which the conventional computer program calculated for a fluid course having the dimensions and surface roughness for the fluid type and flow rate indicated in Table II. The "velocity head" column lists calculated losses associated with fluid acceleration/deceleration; the "friction" column lists calculated losses due to turbulence at the computer simulated wall; the "minor" column lists computed losses due to changes in geometry of the simulated fluid course. The last two columns in Table I list calculated Reynolds numbers and friction factors.

Figure 3:
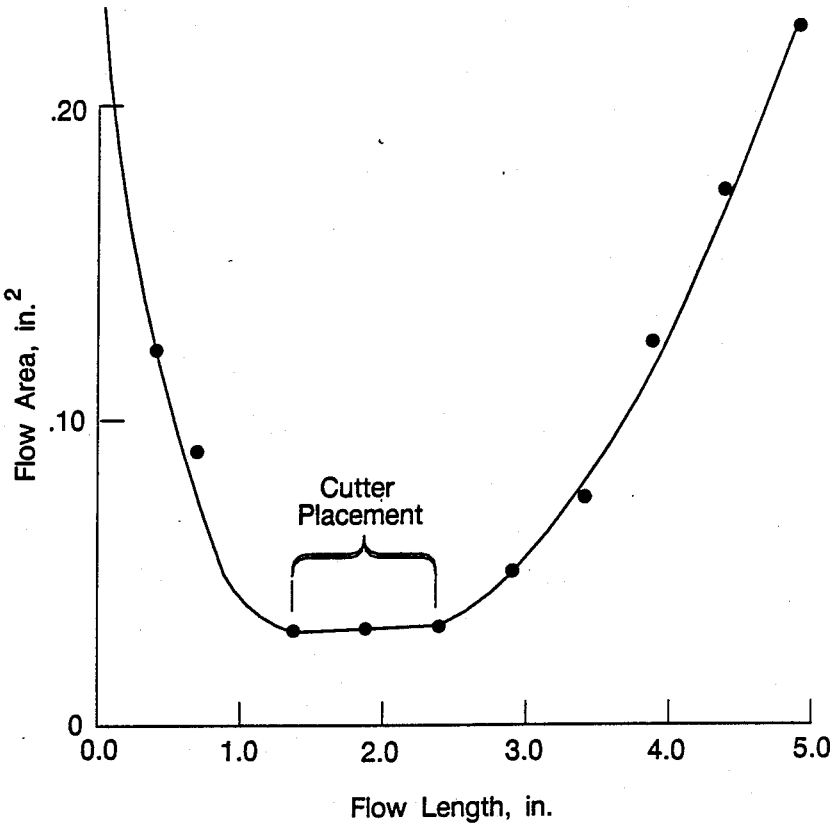
FIG. 3 is a graphical representation of flow area versus flow length corresponding to the data entered in Table II.

FIG. 3 is a graphical representation of the flow area versus flow length past the bore of the simulated fluid course, which representation correlates to the dimensions listed in Table II. These dimensions represent one fluid course, but the simulation was performed as if nine of these fluid courses were defined in the drill bit. Nine channels were selected because such design would provide adequate space for the attachment of sufficient cutting members for an 8½ inch bit.

For the data listed in Table I, the cutting member would begin at 1.65 inches from the axial bore fluid passage. At a point of 2.65 inches, the calculated velocity of the fluid is approximately 400 feet per second and the pressure drop is approximately 1005 psi below the reference pressure computed at the 4.150 location representing the annulus. The total computed pressure drop from inlet to annulus is approximately 572 psi for a flow rate of 40 gallons per minute through the nine flow channels.

For other designs and flow rates evaluated on the same basis as the foregoing, our computations showed a pressure reduction of approximately 4200 psi below annular pressure with a bit pressure drop of approximately 2500 psi. This would require a velocity in front of a cutting member of approximately 900 feet per second.

The foregoing examples were developed from the standpoint of attempting to obtain optimum results. As will become more apparent hereinbelow, such optimization is dependent upon the particular design of the diffuser 34. It is to be noted, however, that less than optimum design can be used, to a point, while still obtaining a negative pressure differential. An example of this is illustrated in Table III.

TABLE III

| LENGTH | VELOCITY | PRESSURE | VELOCITY HEAD | FRICTION | MINOR | REYNOLDS | FRICTION FACTOR |
|---|---|---|---|---|---|---|---|
| 0.000 | 25.67 | 1920.6 | 14.363 | 0.26 | 2.39 | 35731. | 0.006806 |
| 0.250 | 51.34 | 1903.6 | 0.000 | 0.42 | 0.00 | 35731. | 0.006806 |
| 0.650 | 51.34 | 1903.2 | 0.000 | 0.31 | 000 | 35731. | 0.006806 |
| 0.950 | 51.34 | 1902.9 | 0.000 | 0.21 | 0.00 | 35731. | 0.006806 |
| 1.150 | 51.34 | 1902.7 | 1310.739 | 126.69 | 514.93 | 102088. | 0.008164 |
| 1.650 | 427.81 | 49.7 | −84.416 | 115.88 | 0.01 | 100651. | 0.008123 |
| 2.150 | 414.01 | −81.2 | −76.626 | 106.33 | 0.00 | 99253. | 0.008085 |

TABLE III-continued

| LENGTH | VELOCITY | PRESSURE | VELOCITY HEAD | FRICTION | MINOR | REYNOLDS | FRICTION FACTOR |
|---|---|---|---|---|---|---|---|
| 2.650 | 401.07 | −110.0 | −1165.925 | 0.05 | 1054.88 | 22332. | 0.006886 |
| 3.150 | 20.05 | 0.1 | 0000 | 0.05 | 0.00 | 22332. | 0.006886 |
| 3.650 | 20.05 | 0.0 | 0.000 | 0.05 | 0.00 | 22332. | 0.006886 |
| 4.150 | 20.05 | 0.0 | | | | | |

For the same flow rate and velocity in front of a cutting member as used in the example represented in Tables I and II, the inlet-to-annulus pressure for the example having the results listed in Table III is increased to 1920 psi and the pressure reduction in front of the cutting member is reduced to approximately 110 psi below the annular pressure.

Figure 4:
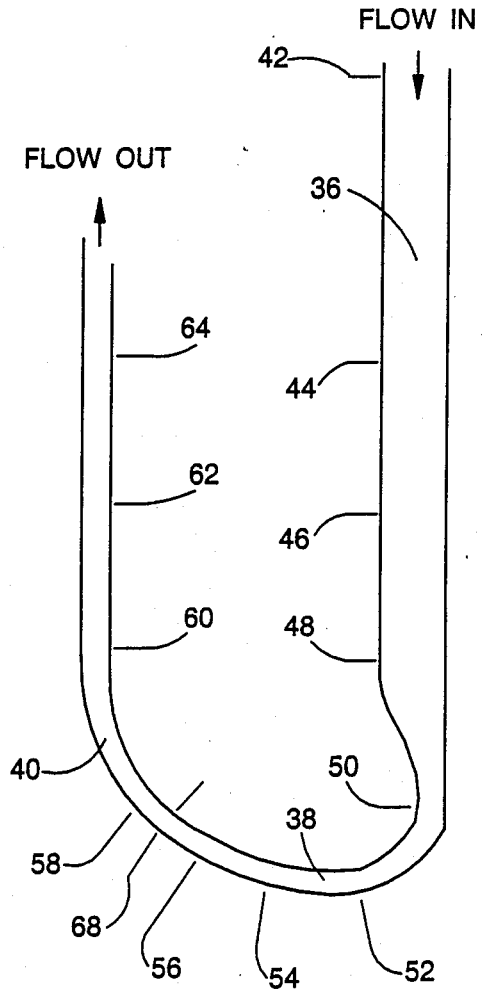
FIG. 4 is a schematic elevational view of a flow channel formed in a plate for purposes of testing.

In continuing our development and evaluation, we have also had a physical fluid course built through a flat LEXAN plate. A schematic diagram of the pertinent portion of this fluid course is shown in FIG. 4. The fluid course depicted in FIG. 4 includes an inlet bore 36 (representative of the bore 26), a throat 38 where a cutting member would be placed (representative of the throat 32), and an outlet including a diffuser 40 (representative of the diffuser 34). The diffuser 40 expands from the cross-sectional area of the throat 38 through an angle of about 7°, the criticality of which will become more apparent hereinbelow. A polymer/water mixture having a plastic viscosity of 4 centipoises and a yield value of 6 pounds per 100 feet-squared was flowed at 15 gallons per minute and pressure readings were taken at locations 42, 44, 46, 48, 50, 52, 54, 56, 58, 60, 62, 64 designated in FIG. 4. These values are recorded on the graph shown in FIG. 5. A curve 66 is fit to these points. The top of the bit simulated by the fluid course shown in FIG. 4 is represented by the point 46 (where a pressure of approximately 710 psi was measured) and the annulus is represented by the point 64 (where a pressure of approximately 510 psi was measured). The diffuser 40 starts at the end of the throat 38 at a location designated by the reference numeral 68 shown in FIGS. 4 and 5.

From FIG. 5, it is apparent that the bit pressure drop between points 46, 64 is approximately 200 psi, but that through the use of the diffuser 40 beginning at the point 68, pressures along a significant length of the fluid course (including all of the throat 38 where a cutting member could be located) are below the annular pressure, thus creating a negative differential pressure relative to the pressure in the annulus. That is, there is a negative pressure differential between each of the points 50, 52, 54, 56, 58, 60, 62 and the point 64. The maximum pressure differential is in front of the cutting member, represented on the graph of FIG. 5 by a bar 70. In the test represented in FIG. 5, the maximum negative differential pressure was about 460 psi.

Figure 5:
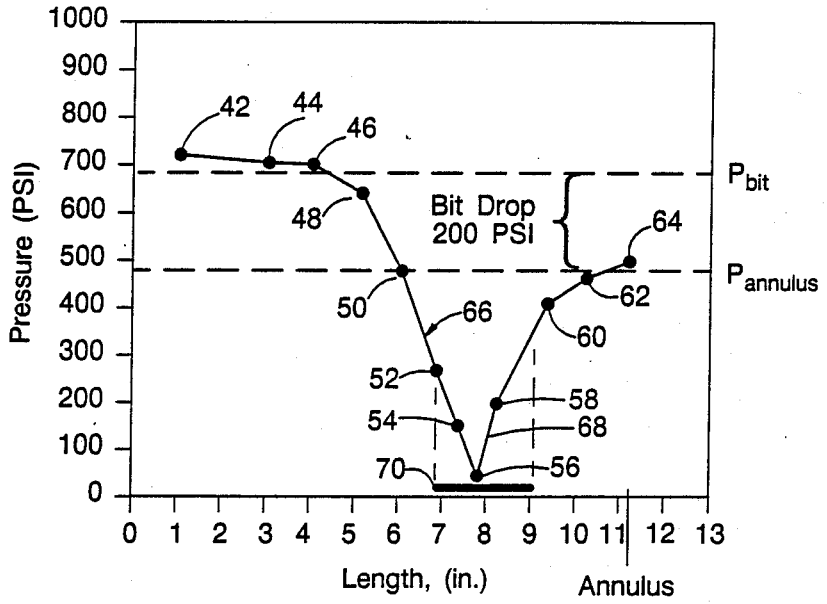
FIG. 5 is a graphical representation of a pressure versus length curve for the flow channel shown in FIG. 4 and thus illustrative of pressures obtainable in a drill bit constructed in accordance with the present invention.

The curve 66 shown in FIG. 5 is to be compared to the curve 2 shown in FIG. 1. With the present invention, the negative pressure differentials illustrated in FIG. 5 are obtainable, whereas for the prior art represented in FIG. 1 they are not.

Figure 2:
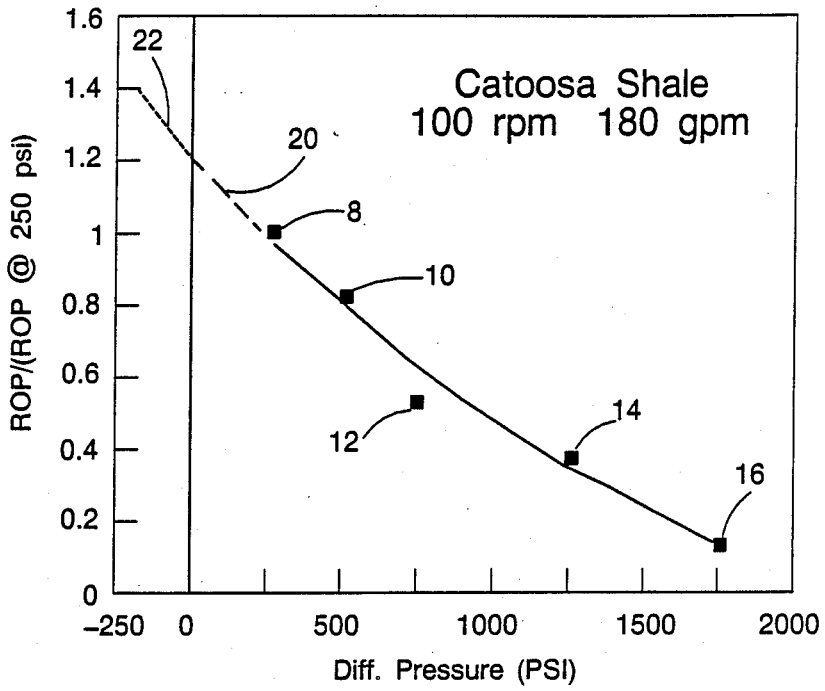
FIG. 2 is a graphical representation of test data obtained to illustrate drilling efficiency versus differential pressure, including an extrapolation of a curve fitting the test data to show the near zero differential pressure contemplated to be obtainable by a prior art drill bit and a further extrapolation into the negative differential pressure region contemplated to be obtainable with the invention.

The curve 66 shown in FIG. 5 is also to be considered relative to the curve shown in FIG. 2. Whereas the prior art can obtain a pressure differential not less than zero, as indicated by the dashed line 20 in FIG. 2, the present invention can produce negative differential pressures as represented in FIG. 5. Thus, our invention extends drill bit technology into the negative pressure differential region shown in FIG. 2. Having demonstrated that a negative differential pressure can be obtained, it is contemplated that an increased drilling efficiency will accompany such negative differential pressure in correspondence to the empirical graph and extrapolations shown in FIG. 2.

As has been alluded to hereinabove, the greatly reduced pressures and the negative pressure differentials are to be obtained by properly defining the outlet structure including the diffuser 34 (FIG. 6) (diffuser 40 in the representation, of FIG. 4).

The construction of the diffuser is to be made to reduce, and hopefully to minimize, outlet turbulence of the flowing fluid as it leaves the throat where it has flowed adjacent the cutting member. If significant turbulence is allowed, it will adversely affect the pressure in front of the cutting member (i.e., the pressure will be higher). In a Venturi tube it is known that when a fluid flows from a larger to a smaller cross-sectional flow passage, the fluid accelerates and the pressure decreases in accordance with Bernoulli's principle. It is also known in a Venturi tube that by reducing turbulence in the outlet flow by controlling the geometry of the outlet, the pressure in the narrower channel which opens into the outlet structure will fall below the pressure in the outlet structure. Although the Venturi tube and the principles thereof have been known within the art of fluid mechanics, they have never, to our knowledge, been utilized to obtain the drill bits, particularly drill bits used for drilling oil and gas wells, of our present invention. We are aware that prior drill bits have fluid courses wherein pressure differentials not less than zero might exist as described hereinabove; however, we are not aware of any prior drill bit designs concerned with an outlet structure of the type within the present invention.

Prior designs of which we are aware could be termed "abrupt" outlet designs. More particularly, prior outlet designs have been such whereby the energy recovered from the flowing fluid, upon it passing from its high velocity adjacent the cutting member to a lower velocity in an outlet therefrom, has been dissipated as turbulence instead of being recovered as pressure as is done in the present invention. That is, after the fluid has been accelerated in front of a cutting member in the present invention, it is gradually decelerated by the outlet structure of the present invention. Recovery of this energy from the high velocity fluid as pressure at a minimum turbulence is what the present invention achieves. In so doing this, it creates a much larger pressure differential, specifically one which extends into the negative pressure differential region heretofore unobtainable in drill bits.

In summary, the present invention has been developed to address the problem of how to improve drilling efficiencies. From laboratory tests from which the graph of FIG. 2 was developed, we observed that drilling efficiencies could be improved by producing lower pressure differentials between the pressure adjacent a cutting member and the annular pressure (or pore pressure) so that the cutting member contacts the material to be drilled within an area of low pressure. We further observed that prior drill bits were limited to a zero or positive pressure differential. We learned through our testing and analysis that the reason for this limitation is the abrupt outlet structures which allow substantial turbulence to occur. As a result, we discovered the solution was to provide a new outlet geometry and construction to prevent or reduce this turbulence so that the energy of the high velocity fluid is recovered as pressure, rather than dissipated as turbulence, as the fluid decelerates. The outlet geometry and construction were concentrated on because anything causing turbulence or frictional pressure losses past the cutting member will increase the pressure at the cutting member relative to the outlet pressure whereas flow upstream of the cutting member is not as detrimental.

While we have invented a drill bit where these relatively large negative pressure differentials can be developed, thereby improving drilling efficiencies, actual designs must be implemented with the limitation that the design must not permit absolute pressures along the fluid course to be below the cavitation pressure.

A schematic illustration of a drill bit 72 incorporating the above-described pressure reduction technique is shown in FIGS. 6–9. As illustrated, the drill bit 72 is of the drag or diamond type, but it is contemplated that the present invention can be embodied in other types of bits. As briefly described hereinabove, the drill bit 72 includes a drill bit body 24, a cutting member 28 and a fluid course 30 extending from an axial bore 26 of the drill bit body 24. For the embodiment depicted in FIGS. 6–9, there are a plurality of such cutting members 28 and fluid courses 30. Each fluid course 30 is associated with a respective cutting member 28. Each fluid course 30 is defined so that pressure of a flowing fluid at the workface of the cutting member is reduced below the bottomhole pressure in the annuls of a borehole where the drill bit is used in a conventional manner (i.e., by being lowered on a drill string, rotated, and lubricated by a fluid pumped down the drill string). Each of the fluid courses 30 is specifically shaped to minimize frictional and turbulent energy losses as fluid is accelerated through the throat 32 of the fluid course and thereafter decelerated through the diffuser 34 of the fluid course. This shaping is essential to keep the total bit pressure losses low and also to allow the pressure in front of the cutting member to fall below the annular pressure. In general, the shape of the diffuser must be carefully controlled to insure the pressure is properly recovered to permit a maximum or desired pressure drop to occur at the cutting member. Efficient operation of the diffuser is essential for the bit to perform as intended by the present invention.

The drill bit body 24 of the drill bit 72 can be a conventional type of drill bit body 24, such as one made of a diamond impregnated, tungsten carbide matrix. The drill bit body 24 has an exterior surface including a face region (which is the region depicted in FIG. 6) extending from a nose area 74 radially outward from an outlet of the axial bore 26 to a gage region (not shown in FIGS. 6–9, but see 118 in FIG. 14), which gage region is typically cylindrical and extends to an annular shoulder (not shown in FIGS. 6–9, but see 119 in FIG. 14) at the bottom of a pin connection structure by which the drill bit 72 is connected to a conventional drill pipe or downhole motor (not shown). In the embodiment depicted in FIG. 6, the nose 74 of the drill bit 72 has an array 75 of surface diamonds for cutting the center of the material to be drilled by the bit 72.

Figure 6:
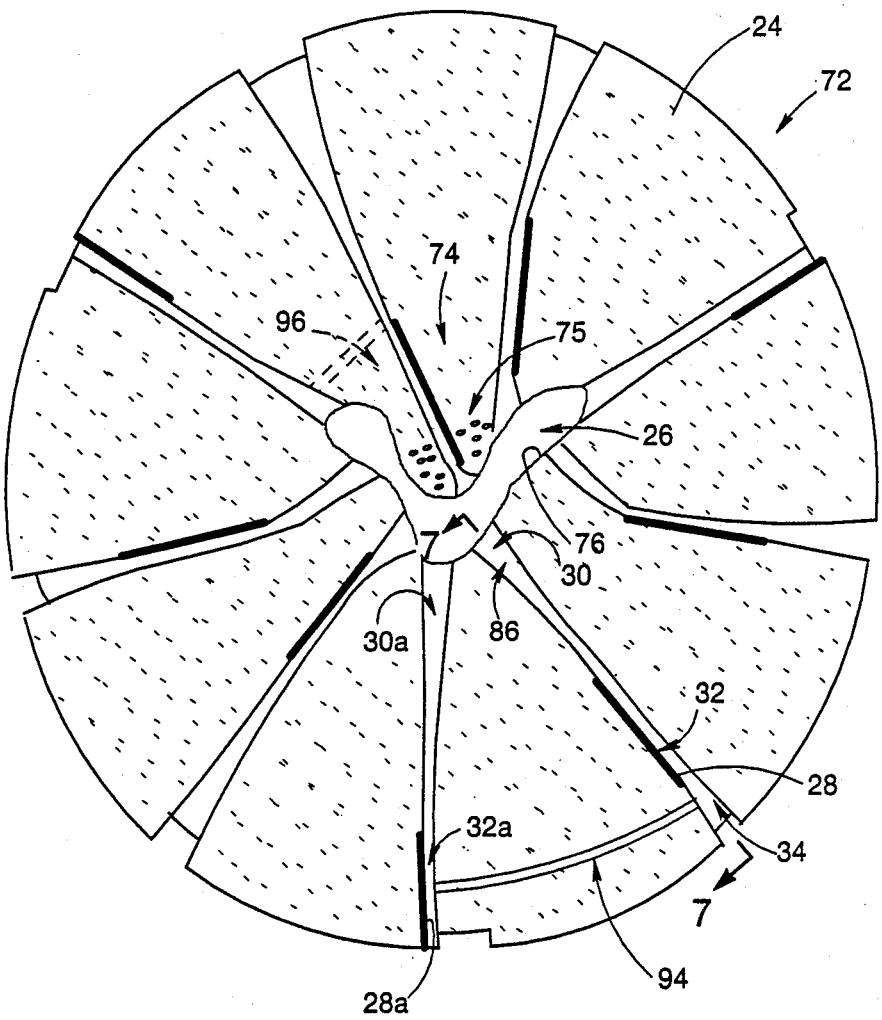
FIG. 6 is a schematic illustration of a face of a drill bit designed in accordance with the present invention.

The aforementioned outlet of the axial bore 26 is shown in FIG. 6 as a conventional "crow's foot" 76. This is an irregularly shaped outlet which is suitably interfaced to the typically cylindrical bore 26 having a cross-sectional area larger than cross-sectional areas of the fluid courses 30 which pass adjacent (particularly, in front of, within the embodiment illustrated in FIGS. 6–9) the cutting members 28.

In FIG. 6, there are shown nine of the cutting members, one of which is identified by the reference numeral 28 and an adjacent one of which is identified by the numeral **28*a*. In the embodiment shown in FIG. 6, the cutting members are spaced substantially equally about the periphery of the drill bit body 24. This configuration is contemplated to be particularly suitable for an 8½ inch drill bit; however, any suitable number of cutting members and any suitable distribution thereof about the face of a drill bit is acceptable. In general what is needed is simply a suitable means, connected to the drill bit body 24, for engaging material to be drilled by the drill bit 72 in response to rotation of the drill bit 72. For the embodiment illustrated in FIGS. 6–9, this is accomplished by the cutting members 28** formed in a planar, elongated fashion of polycrystalline diamond compact (PDC) cutting material, one particular type of which is marketed under the brand STRATAPAX.

Figure 9:
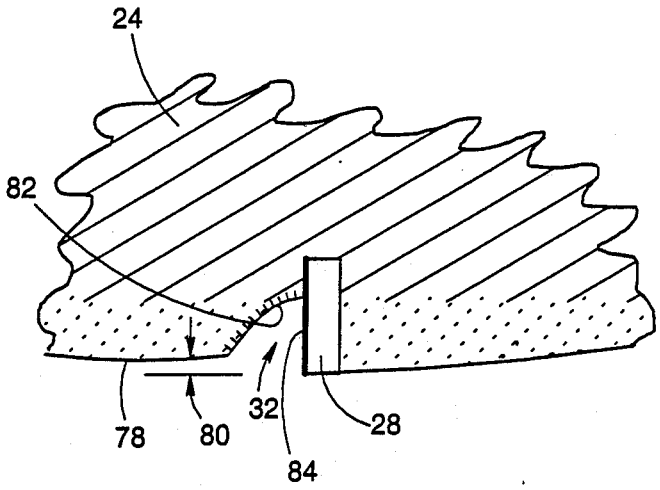
FIG. 9 is a schematic illustration of the portion as viewed along line 9—9 shown in FIG. 7.

As illustrated in FIG. 9, each cutting member 28 of the illustrated embodiment is attached in a suitable manner, such as by brazing, to the drill bit body 24 so that the lower edge of the cutting member 28 extends below a portion 78 of the face of the drill bit body 24 by an offset amount indicated by the reference numeral 80 in FIG. 9. This defines the depth of cut of the cutting member 28 as the drill bit 72 is rotated from right to left as viewed in FIG. 9. The cutter exposure 80 should be controlled so that the portion 78 of the face runs on the material being drilled to keep the fluid confined to the fluid course 30. Cutter wear could be a potential problem in view of the limited exposure of the cutter member 28 below the face of the drill bit body; however, it is contemplated that the higher fluid velocity in front of the cutter member might be sufficient to reduce the cutter wear to minimize this problem.

The higher fluid velocity is obtained in front of the cutting members 28 by controlling the design of the respective fluid courses 30 extending adjacent the cutting members 28. Each cutting member 28 has an associated fluid course. There are nine fluid courses 30 in the FIG. 6 embodiment. Only one is identified by the reference numeral 30, with an adjacent one identified by the reference numeral **30*a*. It is the configuration of each fluid course 30, and specifically the diffuser 34 thereof, which achieves the present invention's advantages of providing greatly reduced pressures at the face of the cutting member 28** and negative pressure differentials relative to the annular pressure.

Although each fluid course 30 for the FIG. 6 embodiment extends radially outward from the crow's foot 76 at the nose 74 of the drill bit body 24 and then along the face and gage of the drill bit body 24, it is contemplated that other orientations of the fluid course 30 on the drill bit body 24 can be used. For example, each fluid course could be angled relative to the radius which might add a further stabilizing feature to the drill bit.

Regardless of the orientation, each fluid course 30 is to include a flow inlet section and a flow outlet section.

The flow inlet section intersects the crow's foot 76 and thus communicates with the fluid flow passage including the axial bore 26. The flow outlet section ultimately opens into an annular pressure region such as a junk slot defined on the drill bit body or simply the annulus itself. The flow inlet section includes the throat 32, and the flow outlet section includes the diffuser 34.

Figure 8:
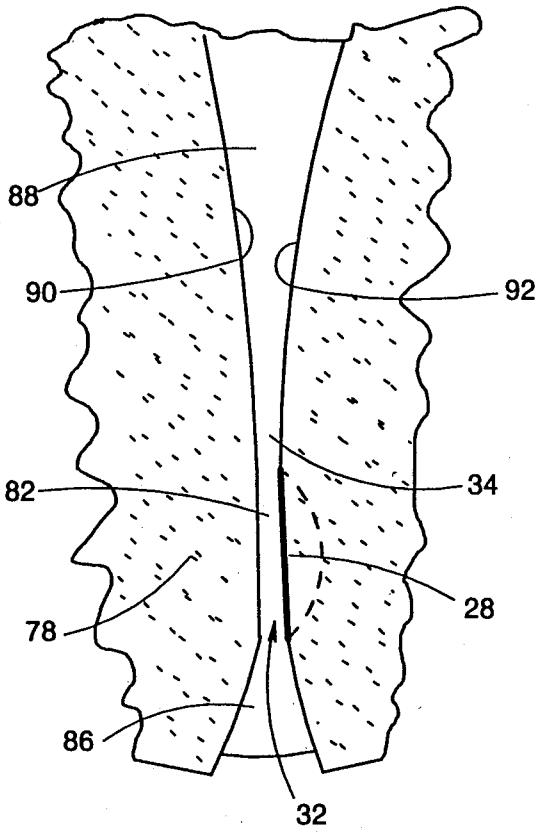
FIG. 8 is an enlarged schematic face view of a portion of FIG. 6, which portion is indicated by the line 8—8 shown in 7.
Figure 7:
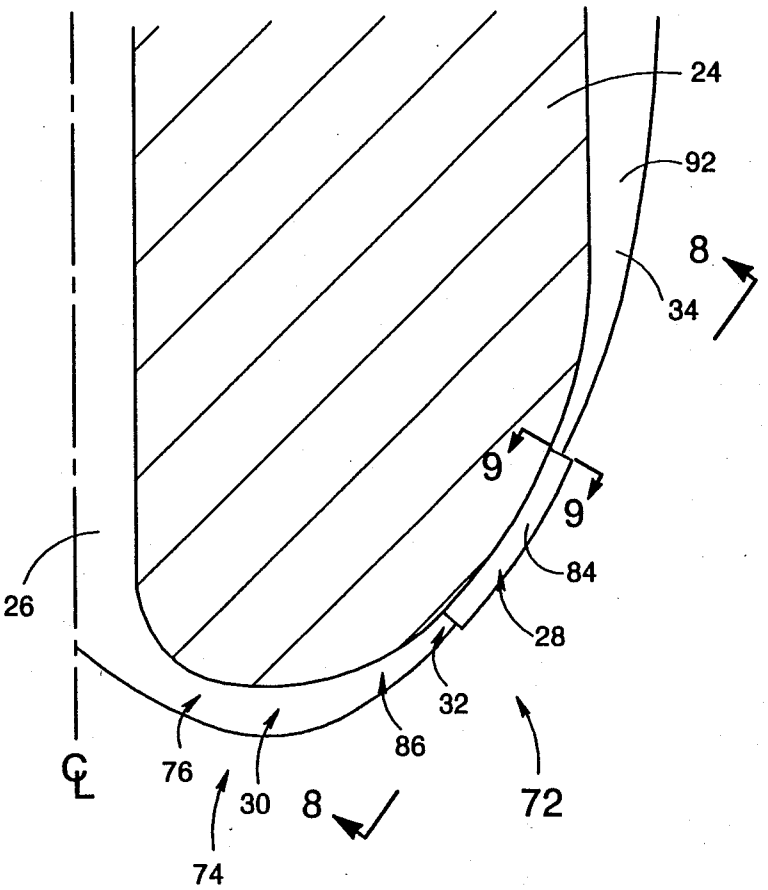
FIG. 7 is a schematic illustration of a section of the drill bit illustrated in FIG. 6 taken along line 7—7 shown in FIG. 6.

The throat 32 is defined by a surface 82 formed on and in the drill bit body 24 as shown in FIG. 9. The surface 82 defines a channel specifically contiguous with an exposed face 84 of the cutting member 28. The channel defined by the surface 82 has a substantially constant width along its length in front of the cutting member 28 (for the curved shape of the surface 82 shown in FIG. 9, there are, of course, multiple "widths" measured between the exposed surface 84 of the cutting member 28 and the surface 82; however, these widths respectively remain substantially constant). This gives the channel defined by the surface 82 a substantially constant cross-sectional area perpendicular to the primary direction of flow through the channel. This cross-sectional area is smaller than the cross-sectional of the axial bore 26 so that fluid flowing down the bore 26 is accelerated as it flows through the relatively constricted throat 32, thereby creating a pressure drop in accordance with Bernoulli's principle. The throat 32 is interfaced to the bore 26 at the crow's foot 76 through a transitional channel 86 having a tapered shape as illustrated in FIGS. 6 and 8. The tapered portion 86 is believed to be conventional in prior drill bits for communicating flow from a larger bore to a smaller channel as represented by the bore 26 and the channel defining the throat 32. The tapering of the channel 86 can be configured to provide further turbulence reduction to assist in obtaining the greatly reduced pressure and the negative pressure differential advantages obtained by means of the present invention.

The diffuser 34 provides a low turbulence, pressure recovering fluid passage. It is defined by a surface 88 (FIG. 8) extending from the surface 82 defining the throat 32. To resist erosion, the surface 88 is preferably made of a hardened material. The surface 88 defines a channel having a continuously varying width, which channel is defined on and in the drill bit body 24 for the embodiment shown in FIGS. 6–9. The surface 88 is curved along its cross-section perpendicular to the primary flow of fluid but can be said as defining or including two side walls 90, 92. The side walls 90, 92 diverge from the throat 32 at a total included angle between the side walls within the range from about 3° to about 30°. That is, the cross-sectional area of the channel of the diffuser 34 continuously increases as the diffuser channel extends from the throat 32 to its point of termination along the gage region of the drill bit body 24. In the preferred embodiment this increase substantially results from the widening within the aforementioned range; the depth is maintained substantially constant. Because the diffuser 34 extends directly from the end of the throat 32, the outlet of the throat 32 and the inlet of the diffuser 34 are coincident and thus have the same cross-sectional area. It is to be noted that the optimum range of from about 3° to about 30° is the same as a known optimum range for reducing turbulent flow in conical diffusers.

The aforementioned structure of each fluid course 30 provides a particular embodiment of a means for conducting fluid from the fluid flow passage provided by the axial bore 26, by the engagement means defined by the adjacent cutting member 28 at a velocity which is greater than the velocity of the fluid in the bore 26, and thereafter at a different velocity less than the velocity of the fluid flowing by the cutting member so that the energy differential of the fluid flowing at the higher velocity and the fluid subsequently flowing at the lower velocity is converted to pressure. In the preferred embodiment shown in FIGS. 6–9, the pressure recovery is from a pressure at the cutting member 28 below the annular pressure to the annular pressure existing of the outlet of the diffuser 34, which annular pressure may be referred to as a reference pressure external to the drill bit body 24.

From the foregoing, it is apparent that the present invention provides a drill bit which directs the flow of a drilling fluid through a relatively large channel (the bore 26), then through a relatively small channel (the throat 32), then along a channel having a width which varies at an angle within a relatively small range of angles (the diffuser 34), and into a substantially uncontrolled channel, such as a junk slot or the annulus adjacent the exterior of the drill bit. A principal feature of this construction is the angle of divergence of the diffuser 34; however, other features thereof can further enhance the reduction or prevention of turbulence through the fluid course 33.

One such further feature is to make the surfaces of the fluid course 30 as smooth as possible to reduce friction. A conventional matrix material cast around a carbon negative of the fluid course 30 should provide a sufficiently smooth surface. It may also be possible to enclose the diffuser 34 completely inside the drill bit body 24 so that the smoothness of the resulting channel can be controlled on all sides (in the embodiment illustrated in FIGS. 6–9, the channel of the diffuser 34 is a slot which is enclosed along its open side by the material to be drilled; therefore, the smoothness of this surface cannot be controlled).

Another such feature is to construct the diffuser 34 to try to minimize erosion resulting from the abrasive action of the flowing fluid. Limited testing, such as performed on the plate in which the fluid course depicted in FIG. 4 was made, indicates that erosion may occur mostly along the top of the fluid course which would be enclosed by the material being drilled and the bottom of the fluid course between the side walls. Small irregularities in the fluid course surface significantly increase the erosion, hence the need for smoothness as mentioned above. The highest erosion appeared to occur in the first 1-inch radius where the flow streamlines have the highest curvature. To avoid this, possibly the flow direction change and fluid acceleration can be done in series rather than simultaneously. Other possible ways of minimizing erosion are to use a geometry which minimizes boundary separation, such as by laser treating the channel surface to provide a more erosion resistant finish, or by using a ceramic insert for the fluid course. It seems feasible to have adequate erosion resistance to reduce the pressure by about 1000 psi, which would correspond to a velocity of about 400 feet per second in front of the cutting member 28. To obtain a pressure reduction of 4000 psi, corresponding to a velocity of 900 feet per second in front of the cutting member, may not be practical with present technology.

A specific way to reduce turbulence in the flow through the throat 32, and the diffuser 34 is to communicate the inlet of the diffuser 34 to a pressure source so that either a suction or an injection of fluid is applied to the beginning of the diffuser 34. This can be done for each diffuser of the embodiment of FIGS. 6–9 or of other embodiments.

This is done in the embodiment shown in FIG. 6 by defining a channel 94 communicating the diffuser 34 with a location of the drill bit body 24 remote from the respective diffuser and having, when a fluid flows through the bore 26 and the fluid courses 30, a pressure different from a pressure within the diffuser 34 where the communication occurs. The channel 94 particularly defines a means for applying a suction to the diffuser 34 by having one end of the channel 94 communicating with the diffuser 34 and the other end of the channel 94 communicating with the throat 32*a* of another fluid course 30*a* as illustrated in FIG. 6. This provides a suction to the diffuser 34 because the pressure at the throat 32*a* is less than the pressure at the location where the channel 94 intersects the diffuser 34.

A higher pressure source could be communicated to the diffuser 34 to inject fluid into the fluid channel of the diffuser 34. A means for doing this is a channel 96 which is depicted in dot-dash lines in FIG. 6. The channel 96 communicates the diffuser 34 to the inlet of the fluid course where, when a fluid is pumped therethrough, there is a pressure higher than in the diffuser 34 at the location at which the channel 96 intersects the diffuser.

The concept of injecting fluid or applying a suction to a diffuser to reduce turbulence is a known concept within the art of fluid mechanics or fluidics; however, the drill bit 72 shown in FIGS. 6–9 having a structure by which this known concept is utilized has not, to our knowledge, heretofore been known.

Figure 11:
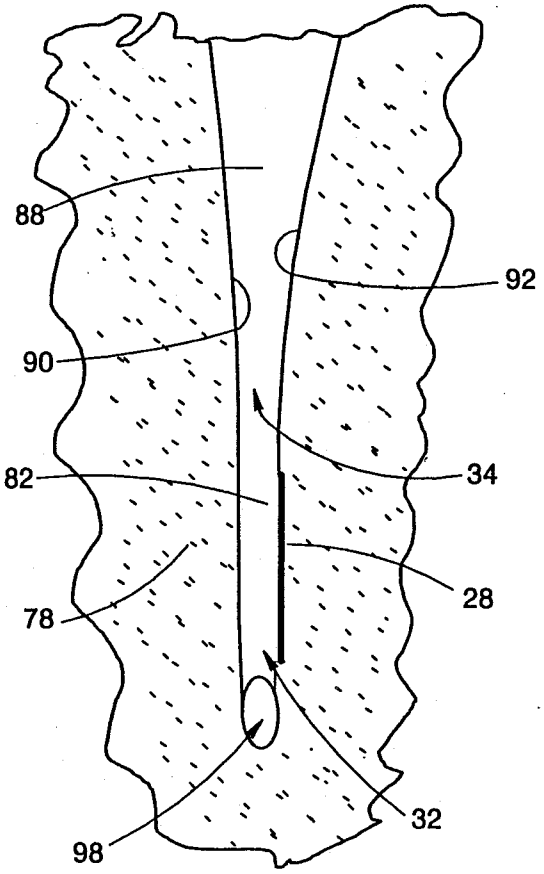
FIG. 11 is a view corresponding to the view shown in FIG. 8, for the embodiment illustrated in FIG. 10.
Figure 10:
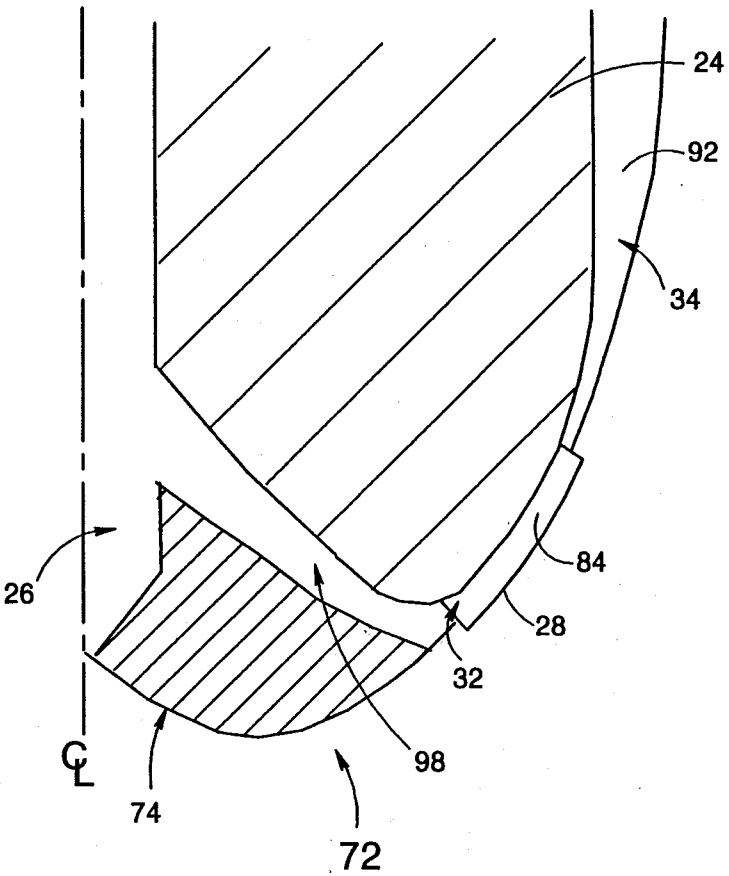
FIG. 10 is a view corresponding to the view shown in FIG. 7, but showing a different channeling design.
Figure 13:
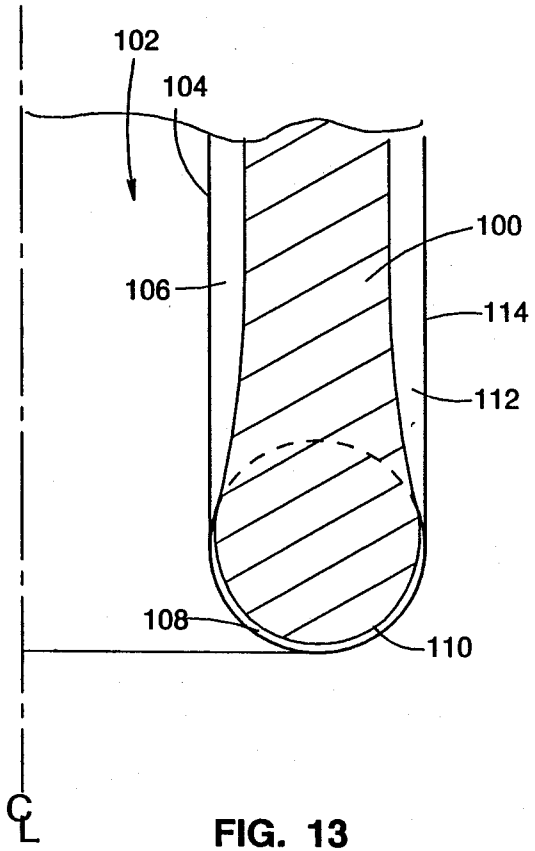
FIG. 13 is a schematic illustration of a partial section taken along line 13—13 shown in FIG. 12.
Figure 12:
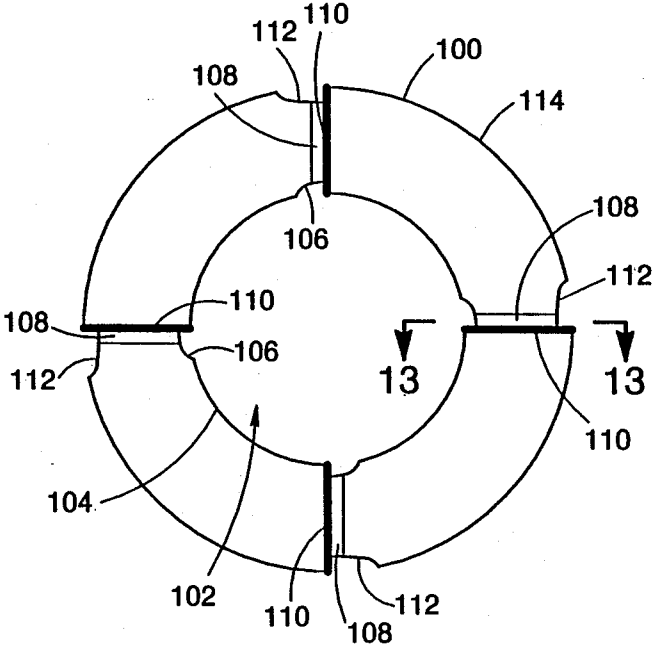
FIG. 12 is a schematic illustration of a face of a core bit designed in accordance with the present invention.

Referring next to FIGS. 10 and 11, another embodiment of the present invention will be described. This embodiment is the same as the embodiment shown in FIGS. 6–9 as indicated by the use of the same reference numerals, except for internal flow distribution ports 98. There is one such port 98 for each fluid course 30. Each port 98 is formed within the drill bit body 24 to connect the axial bore 26 to a respective fluid course 30. Each port 98 defines at its outer end a shaped flow inlet into the respective throat 32.

The concept of the present invention can also be applied to other types of bits. A core bit 100 is schematically represented in part in FIGS. 12 and 13. The core bit 100 has a hollow center passageway 102 defined by an inner cylindrical surface 104. Indentations 106 in the surface 104 define fluid acceleration sections through which a fluid flows downwardly towards high velocity sections 108 adjacent cutting members 110. Fluid passing through the sections 108 controllably exits through diffuser sections 112 defined by indentations in a cylindrical outer surface 114 of the core bit 100. The design of the diffuser sections 112 is in accordance with the design described hereinabove with reference to the embodiment shown in FIGS. 6–9 to obtain the same advantages. The components of the core bit 100 and the cutting member 110 can be conventional. An example of a particular type of cutting member 110 is a relatively large diameter (1½ inch) STRATAPAX brand cutting member.

Figure 14:
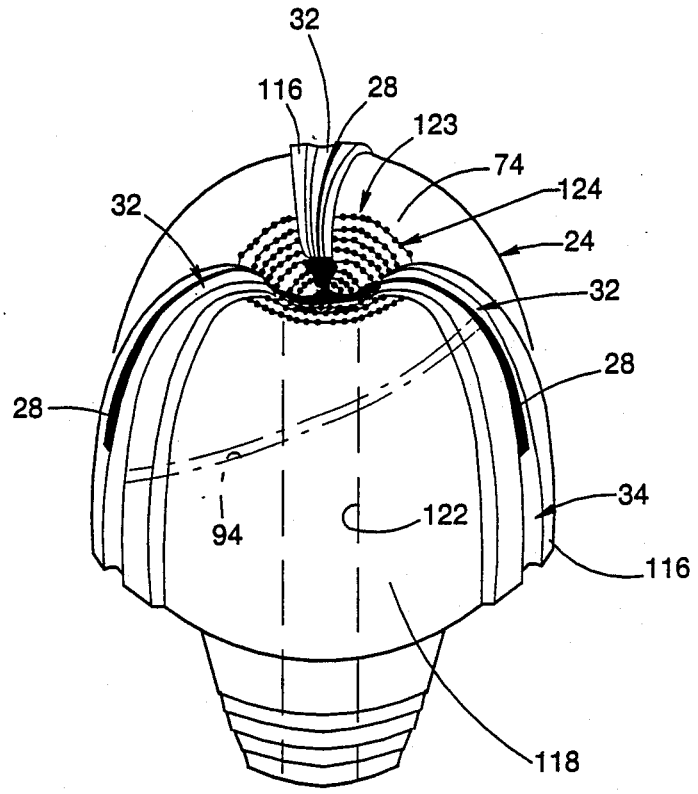
FIG. 14 is a schematic illustration representing a perspective view of another embodiment of a drill bit designed in with the present invention.

Referring next to FIGS. 14–23, there is disclosed a specific design for a 4⅜ inch diamond drill bit having elements the same as those shown in the embodiment of FIGS. 6–9, as indicated by the use of like reference numerals, except for a plurality of wear pads 116 shown in FIG. 14 and the more detailed design information shown in FIGS. 14–23.

In each of the wear pads 116, a respective one of the fluid courses 30 is defined and a respective one of the cutting members 28 is disposed. Also depicted in FIG. 14 is a surface 118 of the drill bit body 24, which surface 118 defines the aforementioned gage section in the matrix junk slot area. Specific dimensions are shown in FIGS. 18–23; these are measured, not projected, dimensions. Such dimensions are by way of example and are not to be taken as limiting the present invention.

The drill bit body 24 of the embodiment shown in FIG. 14 has an upper end (shown at the bottom of FIG. 14) at which a threaded shank 120 is located. The threaded shank 120 is connectible to a drill pipe or downhole motor (not shown). Opposite the shank 120 is the nose 74 at the lower end of the drill bit body 24. Extending between these two ends is an inner surface 122 defining the axial bore 26. The inner surface 122 intersects at the lower end of the drill bit body 24 with the outer surface thereof defining the face and gage portions. Inside the nose 74, a plurality of cutting elements 124, such as individual diamonds, are disposed.

The fluid distribution at the center of the drill bit body 24 is accomplished by using the conventional crow's foot 76, with each branch of the crow's foot connected directly to a single fluid course 30. The inside portion of the nose 74 of the drill bit body is set with the natural diamonds 124 to cut the rock in the center portion of the hole and to form a flow diverter away from the junk slots into the fluid courses. The sizing and layout of these diamonds should be consistent with conventional diamond bit design technology, but they probably should be ridge set in order to minimize the fluid leakage in a radial direction. It is preferable to keep the total flow across these cutters, outside the fluid courses, to no more than approximately 10% of the total flow rate. This is not to be in any way limiting of the present invention, however, as there may be a better design for the center of the drill bit body, which in any event is not critical to the present invention.

Figure 15:
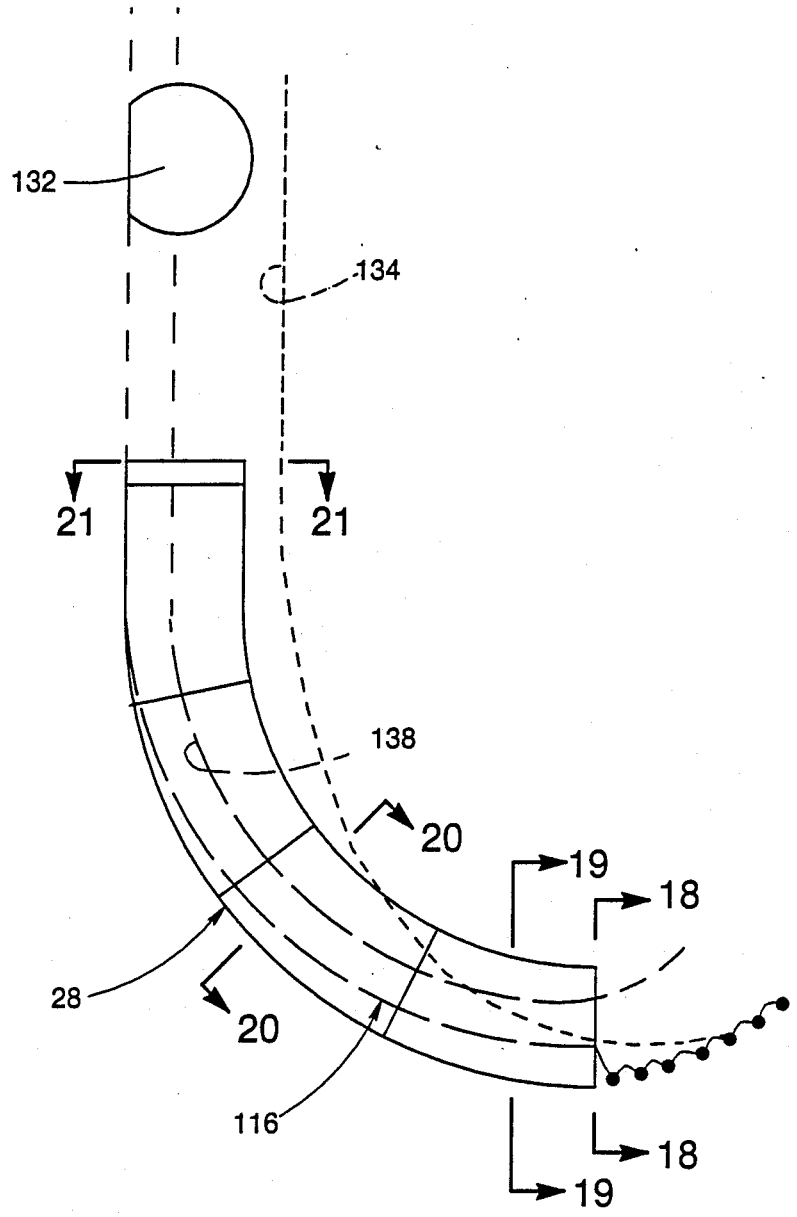
FIG. 15 is a schematic illustration representing one cutting member of the embodiment shown in FIG. 14 in a downward in-use position.
Figure 16:
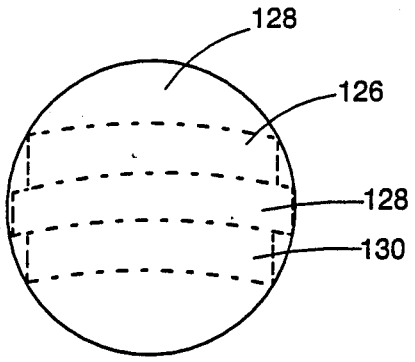
FIG. 16 is a plan view of a PDC cutter disk marked to indicate three curved segments which are to be cut therefrom.
Figure 17:
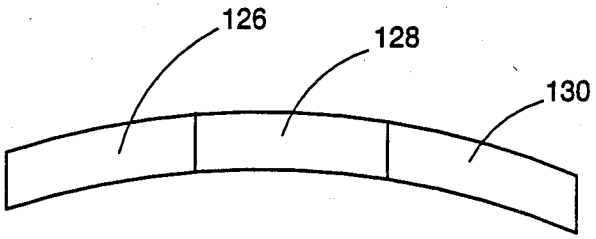
FIG. 17 illustrates the three segments marked in FIG. 16 after they have been cut and aligned to define a single elongated cutting member of the type illustrated in FIG. 15.
Figure 18:
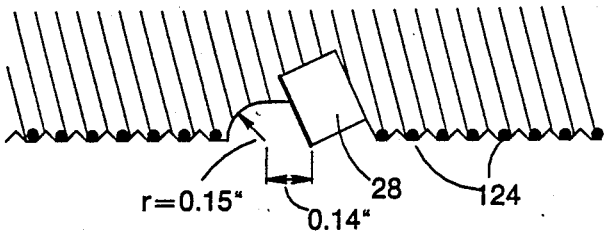
FIG. 18 is a schematic illustration of a sectional view taken along line 18—18 shown in FIG. 15 for the portion of the drill bit shown in FIG. 14 represented thereby.
Figure 19:
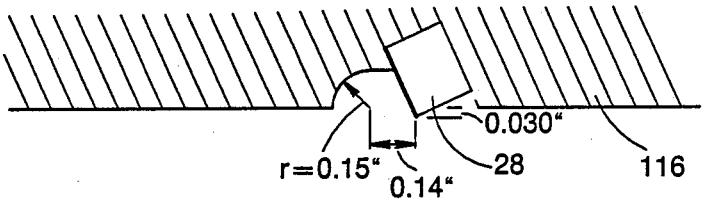
FIG. 19 is a schematic illustration of a sectional view taken along line 19—19 shown in FIG. 15 for the portion of the drill bit shown in FIG. 14 represented thereby.
Figure 20:
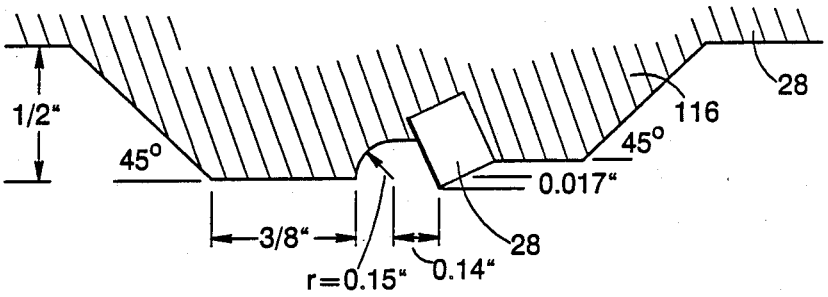
FIG. 20 is a schematic illustration of a sectional view taken along line 20—20 shown in FIG. 15 for the portion of the drill bit shown in FIG. 14 represented thereby.

Attached to the drill bit body 24 of the FIG. 14 embodiment are three cutting members 28. The profile of one of these is represented in FIG. 15. Each cutting member 28 is attached to a respective wear pad 116 area which is in turn attached to the drill bit body 24. Preferably, each cutting member 28 is a continuous elongated planar "blade" of diamond material. It is contemplated that the length of each blade is to be longer than can be obtained from a single piece of commercially available man-made diamond. Therefore, one cutter "blade" 28 can be made by cutting segments from a commercially available diamond disc and installing them adjacent each other as depicted in FIG. 15. For example, a circular STRATAPAX brand PDC disk 125 can be cut in a manner as illustrated in FIG. 16 wherein three pieces 126, 128, 130 (e.g., ¾ inch to 1½ inch long and ⅜ inch wide each) are shown marked for cutting. When the three pieces have been cut from the disk 125, they can be aligned as shown in FIGS. 15 and 17. The joints of adjacent blades are preferably staggered. A single blade formed of adjoined segments is believed to be disclosed in German Patentschrift DE 2821307.

Figure 21:
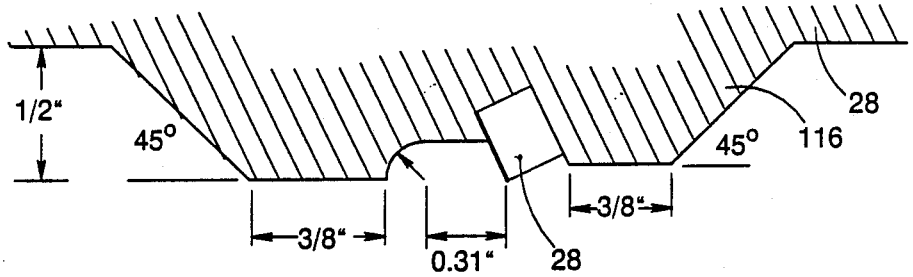
FIG. 21 is a schematic illustration of a sectional view taken along line 21—21 shown in FIG. 15 for the portion of the drill bit shown in FIG. 14 represented thereby.
Figure 22:
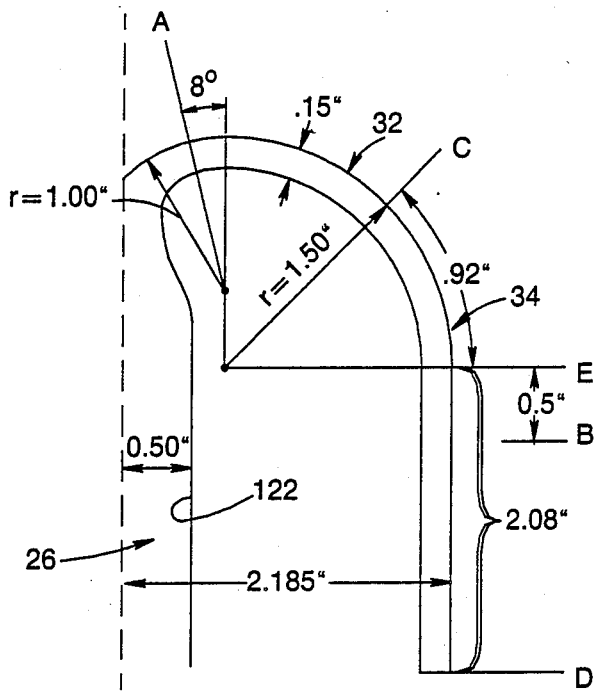
FIG. 22 is a cross-sectional schematic representation of a portion of the bore of the drill bit shown in FIG. 14 and one of the fluid courses extending therefrom.
Figure 23:
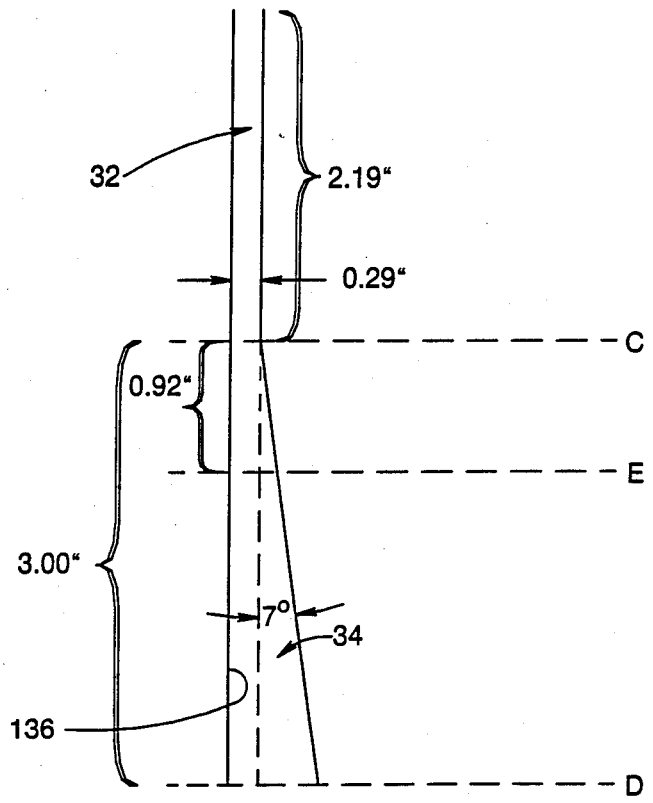
FIG. 23 is a dimensioned representation of the fluid course shown in FIG. 22 as it appears in a flattened face view.
Figure 24:
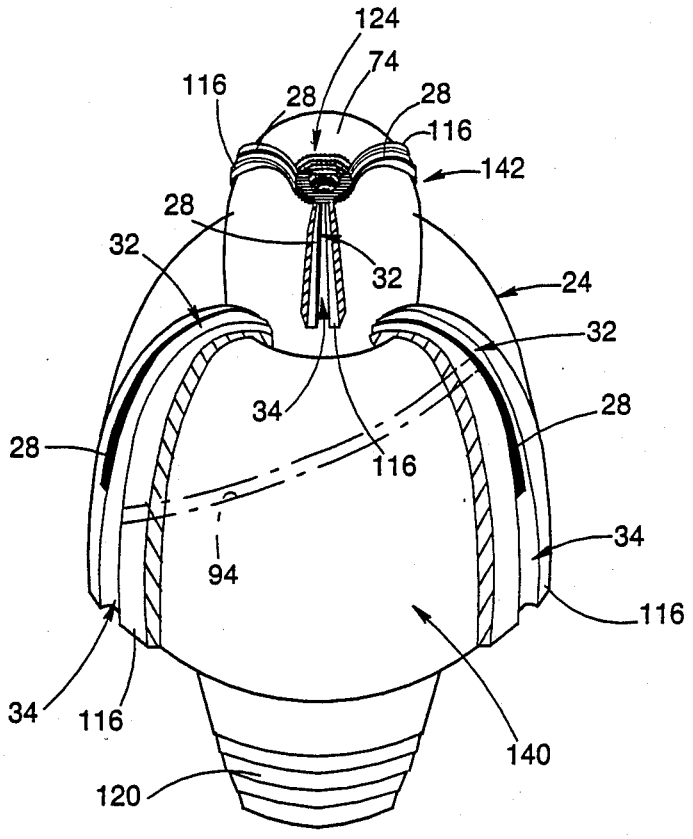
FIG. 24 is a schematic representation of a perspective view of another embodiment of the drill bit designed in accordance with the present invention.
Figure 25:
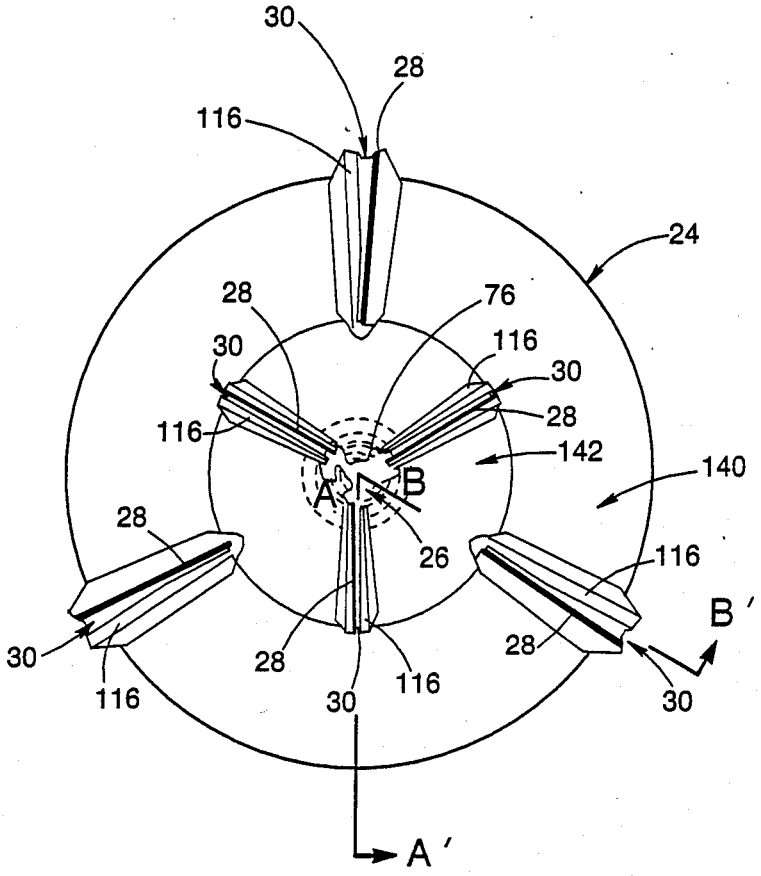
FIG. 25 is a schematic illustration of a top or face view of the drill bit shown in FIG. 24.
Figure 26:
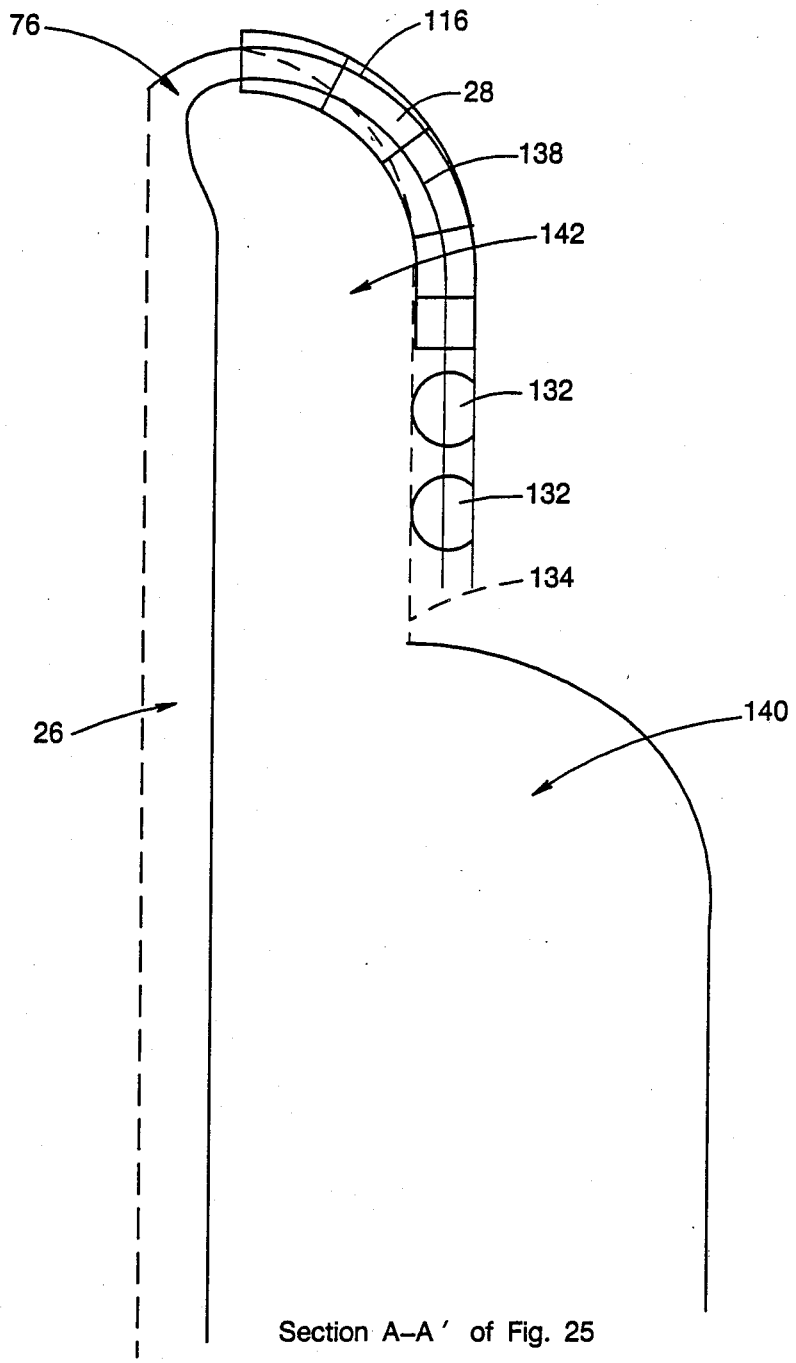
FIG. 26 is a schematic representation of the cross-section A—A' in FIG. 25, showing a portion of the bore of the drill bit and one fluid course and cutting member extending therefrom along a protuberant portion of the drill bit.
Figure 27:
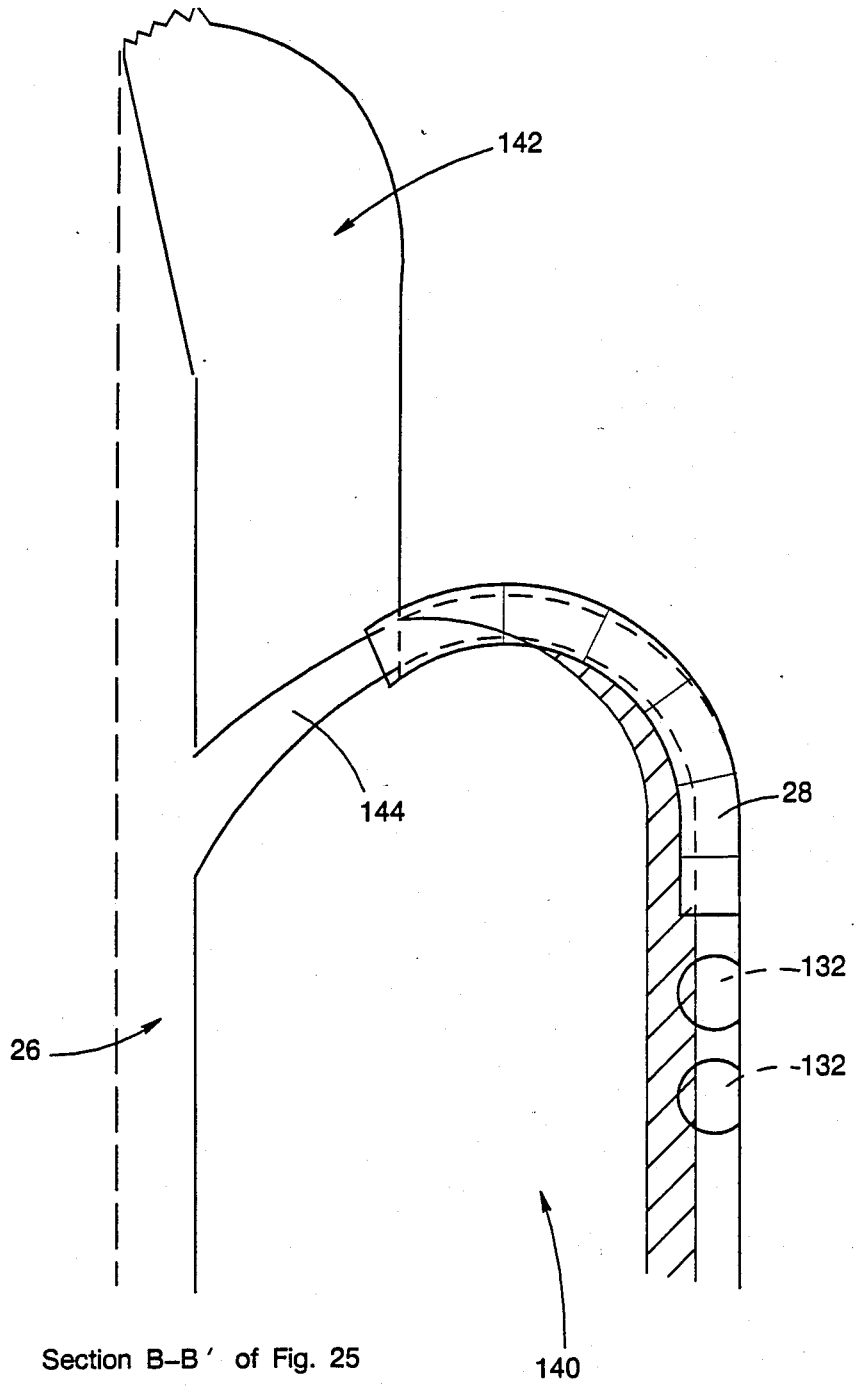
FIG. 27 is a schematic representation of the cross-section B—B' in FIG. 25, showing a portion of the bore of the drill bit and one fluid course and cutting member extending therefrom along a main body portion of the drill bit.

For the embodiment depicted in FIGS. 14–23, the wear pad 116 extends across a radius of the entire face and gage portion of the drill bit body 24. The respective cutting member 28 is spaced above but extends across the face region and across at least a portion of the gage region between locations "A" (inside the indentation 123) and "B" (on the gage portion of the drill bit body)

shown in FIG. 22. The respective throat 32 extends in front of the respective cutting member 28 only across a portion of the face region. The respective diffuser 34 extends from the respective throat 32 across a portion of the face region and across the entire radial length of the gage region so that a portion of the respective cutting member 28 and at least a portion of the respective diffuser 34 are adjacent each other across part of the face region and at least part of the gage region. With reference to FIGS. 22 and 23, the diffuser 34 extends between locations "C" (on the face portion of the drill bit body) and "D" (at the end of the gage portion adjacent the shoulder 119). The throat 32 and the diffuser 34 are shaped in accordance with the present invention as described hereinabove. The aforementioned descriptions of the elements 28, 32 and 34 and the details shown in the embodiment of FIGS. 14–23 are applicable to other embodiments, such as where wear pads are not used.

Referring to FIG. 15, there is also shown an example of a gage maintenance cutter 132 disposed in the drill bit body 24 along the gage portion thereof in a manner and for a purpose as known to the art. Also indicated in FIG. 15 is a surface 134 defining the bottom surface of a junk slot 134 which can be formed in the drill bit body 24 in a known manner and for a known purpose.

The bit of the embodiment shown in FIGS. 14–23 is to be run with sufficient weight on the bit so that the cutting members 28 are fully buried at all times and the wear pads 116 contact the rock or other material to be drilled sealing the fluid within the fluid course. FIGS. 18–21 show cross-sections through one of the cutting members 28 as designated in FIG. 15. These illustrate the elevation of one cutting member 28, the drill bit body 24, and the wear pad 116. Past the rows of ridge-mounted diamonds 124, the cutting member exposure varies from nominally 0.030-inch (FIG. 19) at the nose 74 of the drill bit to nominally zero at the gage portion (FIG. 21). The specified exposure is based on achieving a penetration rate of approximately 90 feet per hour at approximately 200 revolutions per minute. The variable exposure provides a constant contact between the wear pad 116 in front of the cutting member 28 and the material to be drilled at a constant vertical penetration of approximately 0.090 inch per revolution.

The throat 32 and the diffuser 34 of one fluid course 30 of the embodiment shown in FIGS. 14–23 are shown in a laid-out view in FIG. 23. Not shown on this drawing is the respective cutting member 28; in this embodiment it would be attached to a straight side 136 of the fluid course. The nominal width of the throat 32 is shown on FIG. 23. The depth of the fluid course 30 remains constant along the throat 32 and the diffuser 34, but the width is expanded in the diffuser 34 for pressure recovery. Constant depth is preferred because it channels the fluid to have less tendency for separation, which reduces the likelihood of turbulence. The bottom of these portions of the fluid course is identified in FIG. 15 by the reference numeral 138. The nominal depth is indicated in FIG. 22 as being 0.15 inch at the bottom of a quarter-round shape.

As indicated in FIGS. 22 and 23, the diffuser 34 starts at location "C". This is adjacent the cutting member 28. Having the diffuser start adjacent the cutting member 28 is contemplated to be a more efficient design; however, it is further contemplated that the diffuser can be started farther out beyond the edge of the cutting member on the gage section and still have the advantages of the present invention obtained. In FIGS. 22 and 23, the gage section begins at location "E".

The particular embodiment depicted in FIGS. 14–23 is related to the test performed with the fluid course depicted in FIG. 4 and the results represented in the graph of FIG. 5. The depth (width, on the bit fluid course) of the fluid course shown in FIG. 4 is constant up to the point where the diffuser section would begin and then the depth (width, on the bit fluid course) increases. This model simulates the full-scale curvature of the bit but the flow area (and consequently the flow rate) is approximately one-half. In flowing the polymer/water mixture through the fluid course shown in FIG. 4 at 15 gallons per minute, the total bit pressure drop was approximately 200 psi, but the pressure in front of where the cutting member would be located was reduced between approximately 200 psi and approximately 460 psi below the borehole pressure.

The maximum reduction in pressure that can be achieved in any particular design is a function of the square of the fluid velocity in the fluid course in accordance with Bernoulli's principle. The test represented in FIG. 5 was conducted with velocities up to approximately 300 feet per second and this is the design velocity for the bit of FIGS. 14–23 at 90 gallons per minute. Increasing the flow rate to approximately 120 gallons per minute would increase the velocity to approximately 400 feet per second, the bit pressure drop to approximately 355 psi, and the maximum pressure reduction in front of a cutting member to approximately 800 psi.

Referring to FIGS. 24–27, there is shown another embodiment of the present invention. This embodiment is for an 8½ inch drill bit. It is constructed the same as the embodiment shown in FIGS. 14–23, except that the embodiment of FIGS. 24–27 has a double drill bit body construction. A main body portion 140 has a nominal 8½ inch outer diameter, and a protuberant body portion 142 has a nominal 4⅜ inch outer diameter. The protuberant body portion 142 extends forward, to a free end at the nose 74, of the main body portion 140. The bore 26 is defined through both body portions as indicated for one fluid course 30 in FIG. 27. Each fluid course 30 on the main body portion 140 is communicated with the bore 26 through an opening 144 defined through the main body portion 140 near where the protuberant body portion 142 extends from the main body portion. Each such opening extends between the bore 26 and the respective throat 32 of the fluid course. As indicated by the use of the same reference numerals as have been used throughout, the embodiment shown in FIG. 24 includes elements corresponding to those shown in FIGS. 14–23, for example. There are comparable elements both on the main body portion 140 and the protuberant body portion 142. As to the wear pads 116, the cutting members 28 and the fluid courses 30, the ones on the protuberant body portion 142 are circumferentially offset from the ones on the main body portion 140.

Any of the embodiments of the present invention described hereinbelow can be used in a conventional fashion. That is, each described bit body is connected in a conventional manner to a conventional drill string. The drill string, or a part of it such as a part including a mud motor, is rotated in a conventional manner. A conventional drilling fluid is pumped down the drill string in a conventional manner. By means of the present invention, however, an improved drilling efficiency is to be obtained from this otherwise conventional process.

From the foregoing, it is apparent that an important feature of the present invention is the particular geometry of the diffusers 34 so that the desired pressure drop and pressure recovery are obtained.

To further optimize the present invention, other turbulence reducing features, such as smoothness of the fluid course surfaces and the prevention or reduction of boundary separation, can be used. Another feature is to construct the fluid courses to have a suitable life span, such as by using erosion resistant material. Another feature is the combination including the cutting members wherein each has a varied exposure such as described hereinabove with reference to the embodiment shown in FIGS. 14–23.

While presently preferred embodiments of the invention have been described herein for the purpose of disclosure, numerous changes in the construction and arrangement of parts will suggest themselves to those skilled in the art, which changes are encompassed within the spirit of this invention as defined by the appended claims.

What is claimed is:

1. A drill bit, comprising:

a bit body, including:

a main body portion;

a protuberant body portion extending forward, to a free end thereof, from said main body portion; and a fluid flow passage defined through said main and protuberant body portions;

a first cutting member disposed on said main body portion;

a second cutting member disposed on said protuberant body portion;

first fluid course means on said main body portion for defining a first fluid course including a first throat, disposed in front of said first cutting member, and further including a first diffuser, extending from said first throat, said first throat communicating with said fluid flow passage; and second fluid course means on said protuberant body portion for defining a second fluid course including a second throat, disposed in front of said second cutting member, and further including a second diffuser, extending from said second throat, said second throat communicating with said fluid flow passage.

2. A drill bit as defined in claim 1, wherein:

said first fluid course means is circumferentially offset from said second fluid course means.

3. A drill bit as defined in claim 1, wherein:

said bit body further includes an opening extending between said fluid flow passage and said first throat, said opening defined through said main body portion near where said protuberant body portion extends from said main body portion.

4. A drill bit as defined in claim 3, wherein:

said second throat communicates with said fluid flow passage through said free end of said protuberant body portion.

5. A drill bit as defined in claim 1, wherein:

said first diffuser widens at an angle within the range of about 3° to 30°; and said second diffuser widens at an angle within the range of about 3° to about 30°.

6. A drill bit, comprising: a drill bit body including a fluid flow passage;

a cutting member disposed on said drill bit body;

means for defining on said drill bit body in communication with said fluid flow passage a fluid course in front of said cutting member for conducting fluid past said cutting member so that the pressure along at least a portion of said cutting member is less than a reference pressure external to said drill bit body; and means for communicating said fluid course with a location of said drill bit body space from said fluid course and having, when fluid flows through said fluid flow passage and said fluid course, a pressure different from a pressure within said fluid course where said communication occurs.

7. A drill bit as defined in claim 6, wherein:

said means for communicating includes means, on said drill bit body, for applying a suction to said fluid course.

8. A drill bit as defined in claim 6, wherein:

said means for communicating includes means, on said drill bit body, for injecting fluid into said fluid course.

9. A drill bit as defined in claim 6, wherein:

said fluid course includes a section diverging at an angle within the range from about 3° to about 30°.

* * * * *